US005518429A

United States Patent [19]

Gravlin

[11] Patent Number: 5,518,429

[45] Date of Patent: May 21, 1996

[54] KICKBOARD

[76] Inventor: Thomas R. Gravlin, 8467 - 15th Avenue, Burnaby, British Columbia, Canada, V3N 1Y1

[21] Appl. No.: 390,041

[22] Filed: Feb. 17, 1995

[51] Int. Cl.[6] ..... A63B 31/10

[52] U.S. Cl. ..... 441/65

[58] Field of Search ..... 441/65, 129, 135; D21/228; 472/128, 129

[56] References Cited

U.S. PATENT DOCUMENTS

| | | | |
|---|---|---|---|
| 3,042,945 | 7/1962 | Saeman | 441/135 |
| 4,362,518 | 12/1982 | Boissiere . | |
| 4,507,094 | 3/1985 | Hennebutte . | |
| 4,781,638 | 11/1988 | Winters, Jr. . | |
| 5,318,467 | 6/1994 | Mcintyre | 441/65 |

*Primary Examiner*—Sherman Basinger
*Attorney, Agent, or Firm*—Myers, Liniak & Berenato

[57] ABSTRACT

A kickboard for a swimmer which has a rigid, smoothly contoured, buoyant body symmetrical about a longitudinally extending notional plane perpendicular to its top surface and passing through a center thereof. When referenced to the kickboard being supported by a flat horizontal support surface, the top surface is inclined rearwardly, along the intersection with the notional plane, from a front peripheral edge and upwardly from the support surface reaching a maximum and then curving downwardly toward the sides and in a rearwardly direction. A central curvilinear opening extends from proximal the maximum with opening peripheral side edges extending rearwardly, spaced away from respective outer peripheral side edges of the body so as to provide contoured elongated arm receptacles. A bottom surface of the body follows a similar profile as the overlying top surface.

12 Claims, 5 Drawing Sheets

KICKBOARD

FIELD

The present invention relates to a kickboard for a swimmer which can be used for either strengthening the legs by holding the kickboard with the arms or by engaging the kickboard with the legs and exercising the arms and upper body.

BACKGROUND

The most popular conventional kickboard consists of a buoyant rectangular shaped flat body having a slightly rounded front periphery. The latter kickboard offers little streamlining and provides a significant resistance to forward propulsion by the swimmer. Consequently, a beginning swimmer is not generally able to propel this board with significant speed and an intermediate or advanced swimmer cannot propel the board with a speed that is similar to that which he or she can achieve by normal swimming.

U.S. Pat. No. 4,362,518 issued to Boissiere discloses a foam kickboard with rounded edges having a pair of flat, elongated thickened flanks joined by a thinner central, flat web with hand-hold recesses on the sides. Boissiere discloses no streamlining of the bottom or top surfaces.

U.S. Pat. No. 4,886,476 issued to Winters, Jr. discloses a kickboard having a forward planar portion inclined upwardly from a flat, rear portion. The buoyancy of the flat rear portion may be varied by filling it with a selected amount of liquid. No streamlining of the top and bottom surfaces is evident in this patent.

Another problem with the conventional kickboard that is shared by those of the above-mentioned references is that they support the swimmer in a position that does not correspond to the posture assumed while swimming. Consequently, prolonged use often causes soreness of the back.

Accordingly, it is an object of the present invention to provide an improved kickboard for a swimmer. It is a further object of the invention to provide a kickboard whose top and bottom surfaces are contoured to achieve improved streamlining. It is yet a further object of the invention to provide a kickboard which holds the swimmer at a level in the water which corresponds substantially with that assumed during normal swimming.

SUMMARY OF THE INVENTION

According to the invention there is provided a kickboard for a swimmer having a rigid, smoothly contoured, buoyant body symmetrical about a longitudinally extending notional plane perpendicular to its top surface and passing through a center thereof. When referenced to the kickboard being supported by a flat horizontal support surface, the top surface is inclined rearwardly, along the intersection with the notional plane, from a front peripheral edge and upwardly from the support surface, reaching a maximum and then curving downwardly toward the sides and in a rearwardly direction. A central curvilinear opening extends rearwardly from proximal the maximum and has opening peripheral side edges extending rearwardly, spaced away from respective outer peripheral side edges of the body so as to provide contoured elongated arm receptacles whose upper surfaces are concave upwardly. A bottom surface of the body follows a similar profile as the overlying top surface.

Preferably, a bottom surface of the kickboard in the forward region from a front periphery toward the opening defines an inverted gradually narrowing trough so that, when in operation, it directs water flow through the opening with little or no turbulence. The sides of the kickboard may diverge slightly from front to back.

Advantageously, the opening is curvilinear and of increasing width from front to approximately one-half its length toward the back. For approximately three-quarters the length of the body, the top surface of the kickboard along the arm receptacles may be lower than the center along a longitudinal axis thereof. The top surface of the body may also substantially conform in shape to the bottom surface thereof. The opening may extend to the rear periphery thereof or, alternatively, may extend only to a region spaced toward the front from the rear periphery.

The arm receptacles which, when viewed from the side in elevation, are S-shaped allow the user to hold the front portion substantially parallel to the surface of the water with the rear portion inclined slightly downwardly and rearwardly, so that the shoulders and front torso may be positioned lower in the water. Such positioning helps alleviate excess strain on the lower back.

BRIEF DESCRIPTION OF THE DRAWINGS

The novel features believed to characterize the invention are set forth in the appended claims. The invention itself, however, as well as other features and advantages thereof, will be best understood by reference to the detailed description which follows, read in conjunction with the accompanying drawings, wherein:

DETAILED DESCRIPTION WITH REFERENCE TO THE DRAWINGS

Figure 1:
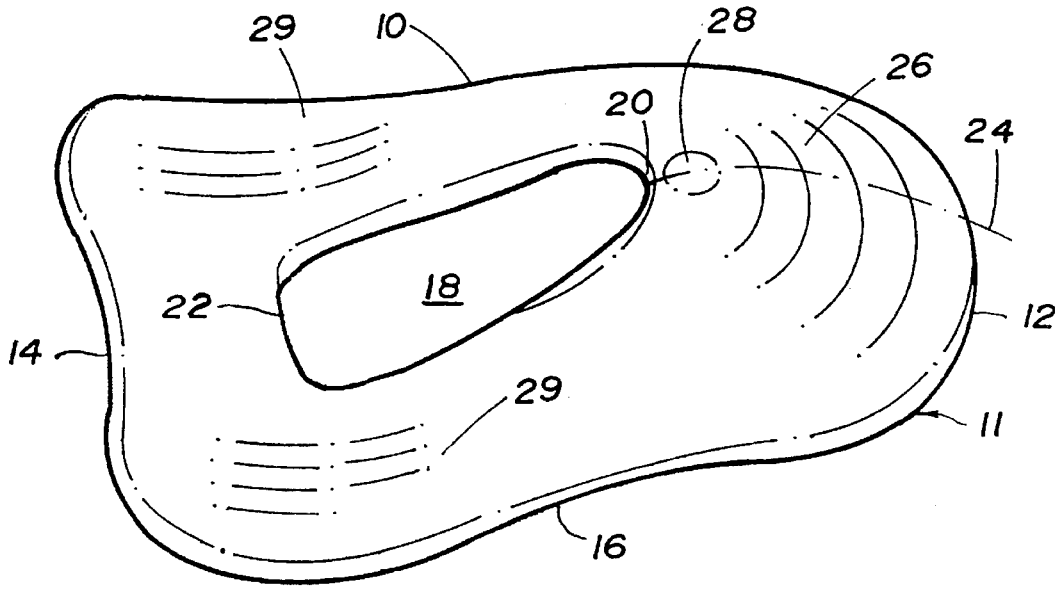
FIG. 1 is a perspective view showing a top surface of the kickboard.
Figure 3:
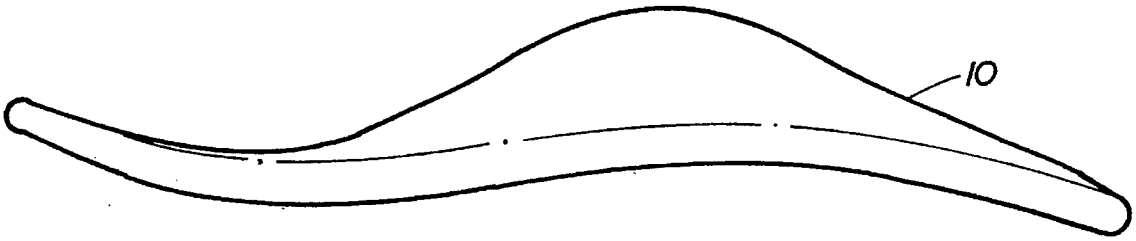
FIG. 3 is a side elevation view of the kickboard.
Figure 4:
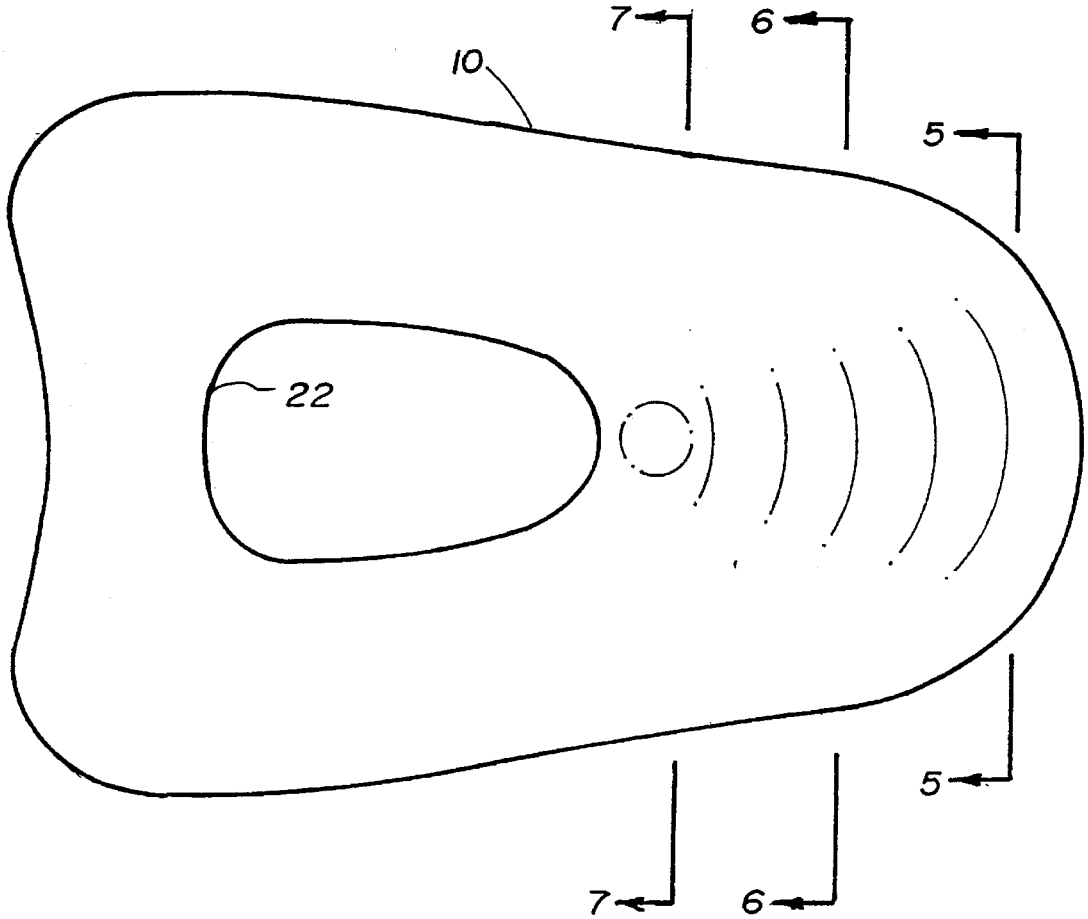
FIG. 4 is a top view of the kickboard.

Referring to FIGS. 1, 3 and 4, the kickboard 10 has generally curvilinear periphery 11 with a rounded front 12, slightly diverging sides 16 and a generally transverse rear periphery 14. An opening 18 in the central region of the kickboard 10 is rounded at a forward end 20 and diverges towards a back end 22 spaced away from the rear periphery 14. With the kickboard 10 resting upon a flat, horizontal surface, a top surface 26 along bisecting line 24 near the front 12 is inclined linearly upwardly towards a maximum 28 at which region the top surface 25 is rounded and then progresses slightly downwardly before terminating at the forward end 20 of opening 18. The sides 29 on each side of opening 18 define a pair of arm receptacles which accommodate the arms of a user whose hands grip the front 12.

Figure 2:
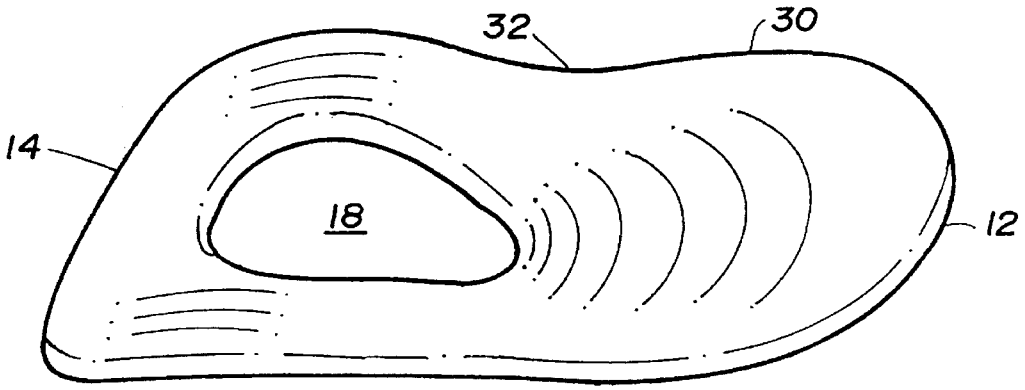
FIG. 2 is a perspective view showing a bottom surface of the kickboard.
Figure 5:
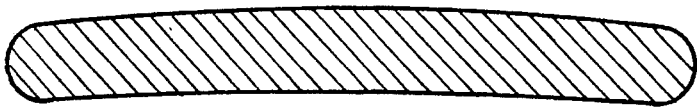
FIG. 5 is a front elevation view in section of the kickboard taken along line 5—5 shown in FIG. 4.
Figure 6:
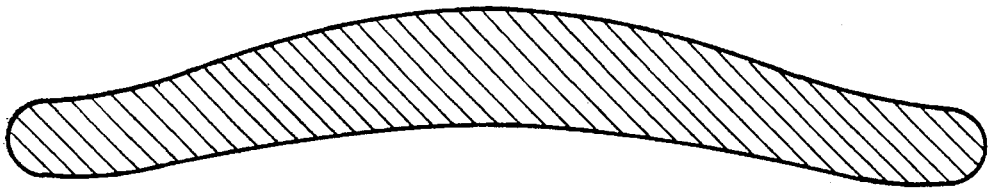
FIG. 6 is a front elevation view in section of the kickboard taken along the line 6—6 in FIG. 4.
Figure 7:
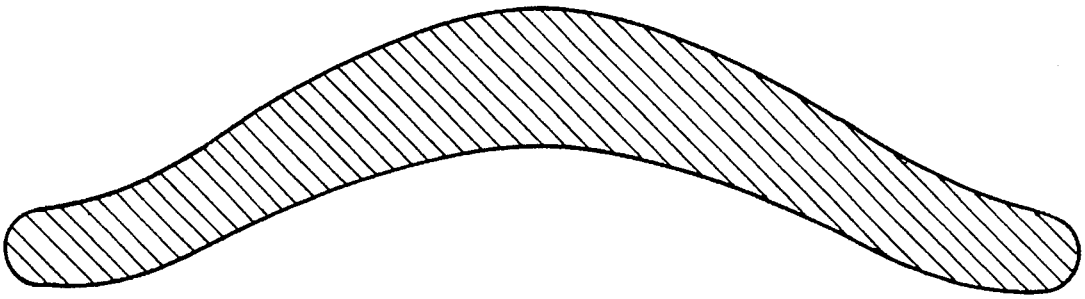
FIG. 7 is a front elevation view in section of the kickboard taken along the line 7—7 in FIG. 4.

Referring to FIG. 2, the bottom surface 32 of kickboard 10 generally conforms in shape to the top surface 26 except that the kickboard 10 is slightly thicker near the center than at the edges in the forward region. Region 30 with the kickboard 10 upside down on a flat horizontal surface defines a funnel-shaped channel with the rounded bottom becoming narrower and the sides steeper as one progresses towards forward end 20 of opening 18 from the front 12. Referring to FIGS. 5, 6 and 7 it is seen that the bottom surface 32 progresses from having only slightly inclined sides as shown in FIG. 5 to slightly more inclined sides in FIG. 6 to more steeply inclined sides and a distinctly rounded bottom as shown in FIG. 7.

Figure 8:
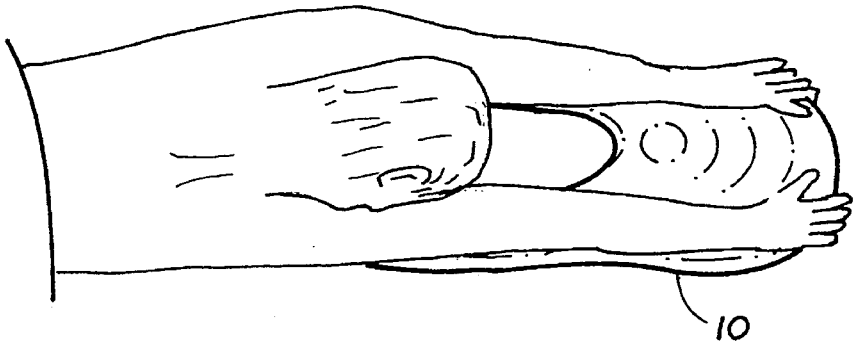
FIG. 8 is a perspective view of the kickboard in use.

Referring to FIG. 8 it is seen that a swimmer grasps the front of the kickboard 10 with his hands and with his arms extending along the arm receptacles 29. In this position the top surface 26 near the front 12 is nearly flat while the arm receptacles 29 are generally inclined downwardly into the water. As the user kicks his legs to propel himself and the kickboard 10 forward through the water, water is funneled into opening 18 so that a smooth flow is established along the bottom region 30. The smooth contoured surface along the underside of the arm receptacles also promotes smooth non-turbulent flow of the water. With the arm receptacles 29 lower in elevation than the top surface along the centre axis, a swimmer may be positioned so that his shoulders and torso are lower in the water. This positioning reduces the strain on a swimmer's lower back.

Figure 9:
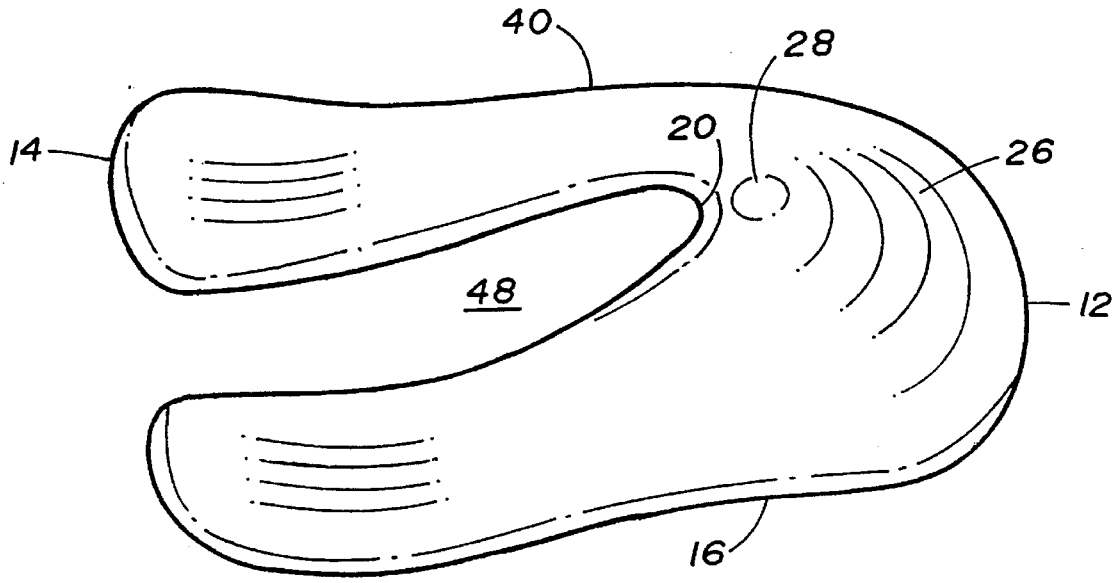
FIG. 9 is a perspective view showing a top surface of a variant of the kickboard having the opening extending to the rear periphery of the body.
Figure 10:
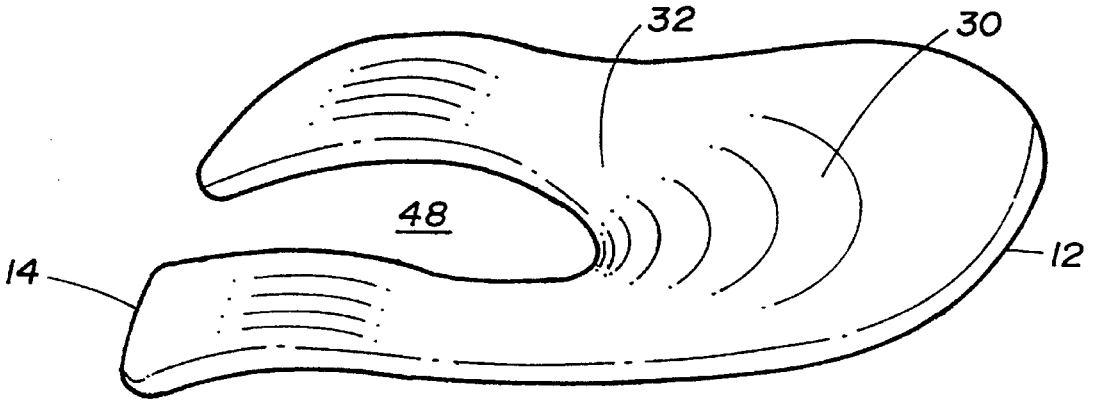
FIG. 10 is a perspective view showing a bottom surface of the variant of FIG. 9.
Figure 11:
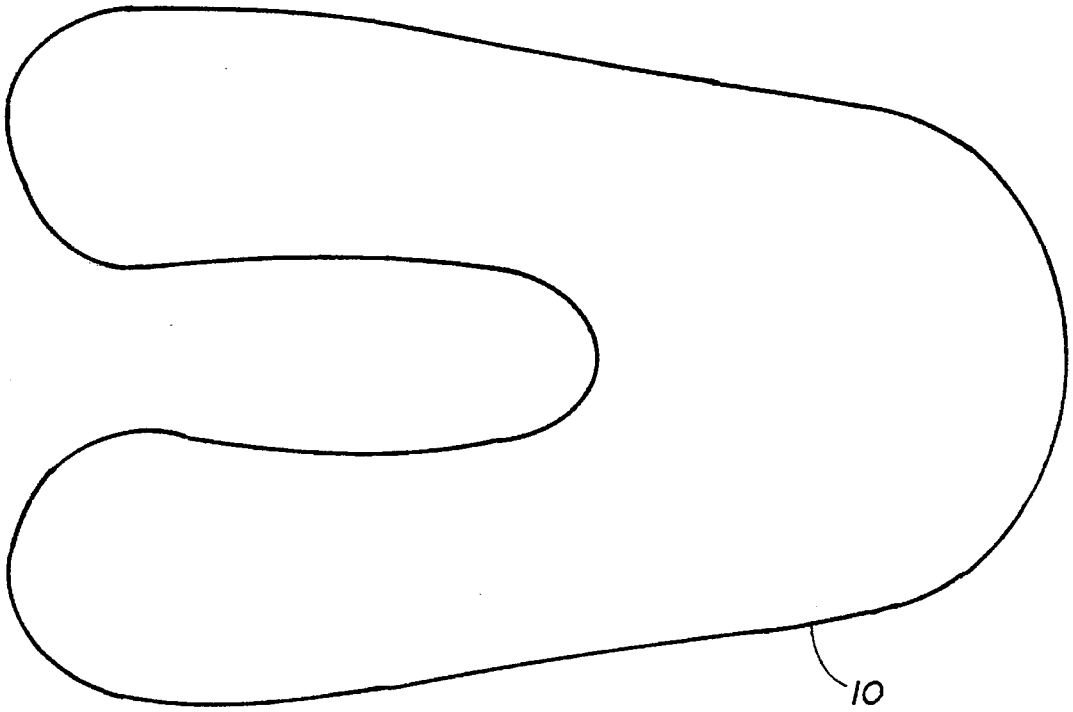
FIG. 11 is a top view of the variant shown in FIG. 9.

Referring to FIGS. 9, 10 and 11, a variant of the kickboard 40 is identical to kickboard 10 except that opening 48 opens to the rear periphery 14. The thickness of the kickboard 40 can be increased gradually toward the rear periphery 14 depending upon the angle or tilt of the kickboard 40 required when in use, the object being to have the top surface 26 near the front substantially horizontal.

Accordingly, while this invention has been described with reference to illustrative embodiments, this description is not intended to be construed in a limiting sense. Various modifications of the illustrative embodiments, as well as other embodiments of the invention, will be apparent to persons skilled in the art upon reference to this description. It is therefore contemplated that the appended claims will cover any such modifications or embodiments as fall within the true scope of the invention.

I claim:

1. A kickboard for a swimmer, comprising: a rigid, smoothly contoured, buoyant body symmetrical about a longitudinally extending notional plane perpendicular to its top surface and passing through a center thereof, and when referenced to said kickboard being supported by a flat horizontal support surface, the top surface being inclined rearwardly, along the intersection with said notional plane, from a front peripheral edge and upwardly from said support surface reaching a maximum and then curving downwardly toward the sides and in a rearwardly direction, a central curvilinear opening proximal the maximum with opening peripheral side edges extending rearwardly, spaced away from respective outer peripheral side edges of said body so as to provide contoured elongated arm receptacles whose upper surfaces are concave upwardly, a bottom surface of said body following a similar profile as the overlying top surface.

2. A kickboard according to claim 1, wherein said a bottom surface of said kickboard in a forward region from a front periphery toward said opening defining an inverted gradually narrowing trough so that when in operation directing water flow through said opening with little or no turbulence.

3. A kickboard according to claim 1, wherein a rear portion of said body curves upwardly slightly.

4. A kickboard according to claim 1, wherein sides of said kickboard, as viewed from the top, diverge slightly from front to back.

5. A kickboard according to claim 1, wherein a front periphery of said kickboard is rounded.

6. A kickboard according to claim 1, wherein said opening is of increasing width from front to approximately one-half its length toward the back.

7. A kickboard according to claim 1, wherein the top surface of said kickboard is inclined downwardly from each point along the central longitudinal axis towards each side with increasing slope in progressing from the front periphery rearwardly to the opening.

8. A kickboard according to claim 1, wherein the top surface thereof substantially conforms in shape to the bottom surface thereof.

9. A kickboard according to claim 1, wherein said opening extends to a rear periphery thereof.

10. A kickboard according to claim 1, wherein said opening extends only to a region spaced toward the front from a rear periphery of said body.

11. A kickboard for a swimmer, comprising: a rigid, curvilinear buoyant body symmetrical about a longitudinal axis thereof, having substantially conforming top and bottom surfaces, and, with reference to the body being supported by a horizontal flat surface, the top surface having a forward, upwardly inclined central region extending from a rounded front periphery rearwardly and sloping downwardly towards the sides reaching a maximum and then curving downwardly and rearwardly terminating in a central opening proximate a center of said body, said opening being substantially elliptical in a region from approximately midway along said board toward the rear of said body, with sides extending rearwardly, spaced away from respective edges of said body so as to provide contoured elongated arm receptacles which curve downwardly and, near the rear, upwardly again, an underside of said body defining an inverted trough of increasing steepness and narrowness as it progresses toward said opening.

12. A kickboard according to claim 11, wherein said arm receptacles when viewed from the sides in elevation are S-shaped.

* * * * *